US005095796A

United States Patent [19]

Genna

[11] Patent Number: 5,095,796

[45] Date of Patent: Mar. 17, 1992

[54] TUNED-PORT RIGID BAFFLE PANEL FOR DRUM TYPE PERCUSSION INSTRUMENTS

[76] Inventor: Robert A. Genna, Turn of River Substation 2, 907 High Ridge Rd., Stamford, Conn. 06905

[21] Appl. No.: 525,200

[22] Filed: May 18, 1990

[51] Int. Cl.[5] ..... G10D 13/02

[52] U.S. Cl. ..... 84/414; 181/156

[58] Field of Search ..... 84/411 R, 413, 414; 181/156

[56] References Cited

U.S. PATENT DOCUMENTS

| | | | |
|---|---|---|---|
| 4,146,111 | 3/1979 | Mae et al. | 181/156 X |
| 4,742,753 | 5/1988 | Speed | 84/411 R X |
| 4,790,228 | 12/1988 | Thirion | 84/411 R |
| 4,805,514 | 2/1989 | Billings | 84/414 X |

OTHER PUBLICATIONS

Weems, "A Second Life for Vented Speakers", Popular Electronics, Jan. 1980.

Boyce, "Hi-Fi Stereo Handbook", (Chap. 7) (1978).

Cohen, "Hi-Fi Loudspeakers and Enclosures", (2nd ed) (Chap. 9) (1968).

*Primary Examiner*—Brian W. Brown

*Attorney, Agent, or Firm*—St. Onge Steward Johnston & Reens

[57] ABSTRACT

A tuned-port rigid baffle panel which mounts to the side opposite the beater drumhead membrane side of acoustic drums and is used by musicians to enhance the live acoustic sound of these drum type percussion instruments by adding low-frequency punch to their performance. This low-frequency response enhancement is achieved by treating the drum as a bass-reflex enclosure and tuning the port of the rigid baffle panel to the appropriate percentage of the free-air resonant frequency of the beater drumhead membrane in order to control the peak amplitude of the beater drumhead membrane at resonance and extend the low-frequency response of the acoustic drum.

20 Claims, 5 Drawing Sheets

FIGURE 7-1

| Bass Drum/ Baffle Dia. Inches | Drum Depth Inches | Drum Inside Dia. Inches | Drum Internal Vol. Cubic Inches | Tuned Port Radius Inches | Tuned Port Area Square Inches | Tuned Port Freq. Hz. |
|---|---|---|---|---|---|---|
| 24 | 14 | 23-1/8 | 5880.0 | 1-15/16 | 11.793 | 50 |
| 24 | 16 | 23-1/8 | 6720.0 | 2-7/32 | 15.466 | 50 |
| 24 | 18 | 23-1/8 | 7560.0 | 2-1/2 | 19.635 | 50 |
| 22 | 14 | 21-1/4 | 4965.2 | 2-3/8 | 17.721 | 60 |
| 22 | 16 | 21-1/4 | 5674.5 | 2-11/16 | 22.691 | 60 |
| 22 | 18 | 21-1/4 | 6383.8 | 3-1/32 | 28.866 | 60 |
| 20 | 14 | 19-1/4 | 4074.5 | 1-31/32 | 12.177 | 60 |
| 20 | 16 | 19-1/4 | 4656.6 | 2-7/32 | 15.466 | 60 |
| 18 | 16 | 17-1/8 | 3685.3 | 1-3/4 | 9.621 | 60 |

| Floor Tom/ Baffle Dia. Inches | Drum Depth Inches | Drum Inside Dia. Inches | Drum Internal Volume Cubic Inches | Tuned Port Radius Inches | Tuned Port Area Square Inches | Tuned Port Freq. Hz. |
|---|---|---|---|---|---|---|
| 20 | 18 | 19-1/4 | 5238.7 | 2-7/16 | 18.665 | 60 |
| 18 | 16 | 17-1/8 | 3685.3 | 2-3/8 | 17.721 | 70 |
| 18 | 19 | 17-1/8 | 4376.3 | 2-13/16 | 24.850 | 70 |
| 16 | 16 | 15-3/16 | 2898.6 | 2-7/16 | 18.665 | 80 |
| 16 | 18 | 15-3/16 | 3260.9 | 2-3/4 | 23.758 | 80 |
| 14 | 14 | 13-1/4 | 1930.4 | 2-1/16 | 13.364 | 90 |
| 14 | 14 | 13-1/4 | 1930.4 | 2-9/16 | 20.629 | 100 |

| Mtd. Tom/ Baffle Dia. Inches | Drum Depth Inches | Drum Inside Dia. Inches | Drum Internal Volume Cubic Inches | Tuned Port Radius Inches | Tuned Port Area Square Inches | Tuned Port Freq. Hz. |
|---|---|---|---|---|---|---|
| 16 | 14 | 15-3/16 | 2536.2 | 2-1/8 | 14.186 | 80 |
| 16 | 16 | 15-3/16 | 2898.6 | 2-7/16 | 18.665 | 80 |
| 15 | 12 | 14-3/16 | 1897.1 | 1-19/32 | 7.980 | 80 |
| 15 | 12 | 14-3/16 | 1897.1 | 2-1/32 | 12.962 | 90 |
| 15 | 14 | 14-3/16 | 2213.2 | 1-7/8 | 11.045 | 80 |
| 15 | 14 | 14-3/16 | 2213.2 | 2-3/8 | 17.721 | 90 |
| 15 | 15 | 14-3/16 | 2371.3 | 2 | 12.566 | 80 |
| 15 | 15 | 14-3/16 | 2371.3 | 2-17/32 | 20.129 | 90 |
| 15 | 17 | 14-3/16 | 2687.5 | 2-1/4 | 15.904 | 80 |
| 15 | 17 | 14-3/16 | 2687.5 | 2-7/8 | 25.967 | 90 |
| 14 | 10 | 13-1/4 | 1378.9 | 1-15/32 | 6.777 | 90 |
| 14 | 10 | 13-1/4 | 1378.9 | 1-13/16 | 10.321 | 100 |
| 14 | 12 | 13-1/4 | 1654.6 | 1-25/32 | 9.968 | 90 |
| 14 | 12 | 13-1/4 | 1654.6 | 2-3/16 | 15.033 | 100 |
| 14 | 13 | 13-1/4 | 1792.5 | 1-29/32 | 11.416 | 90 |
| 14 | 13 | 13-1/4 | 1792.5 | 2-3/8 | 17.721 | 100 |
| 13 | 9 | 12-1/4 | 1060.7 | 1-13/32 | 6.213 | 100 |
| 13 | 11 | 12-1/4 | 1296.4 | 1-23/32 | 9.281 | 100 |
| 13 | 12 | 12-1/4 | 1414.3 | 1-7/8 | 11.045 | 100 |
| 12 | 8 | 11-1/4 | 795.2 | 1-17/64 | 5.032 | 110 |
| 12 | 10 | 11-1/4 | 994.0 | 1-19/32 | 7.980 | 110 |
| 12 | 11 | 11-1/4 | 1093.4 | 1-3/4 | 9.621 | 110 |
| 12 | 12 | 11-1/4 | 1192.8 | 1-29/32 | 11.416 | 110 |
| 10 | 6-1/2 | 9-1/4 | 436.8 | 7/8 | 2.405 | 120 |

FIGURE 7-2

| Mtd. Tom/ Baffle Dia. Inches | Drum Depth Inches | Drum Inside Dia. Inches | Drum Internal Volume Cubic Inches | Tuned Port Radius Inches | Tuned Port Area Square Inches | Tuned Port Freq. Hz. |
|---|---|---|---|---|---|---|
| 10 | 8 | 9-1/4 | 537.6 | 1-1/64 | 3.241 | 120 |
| 10 | 9 | 9-1/4 | 604.8 | 1-5/32 | 4.200 | 120 |
| 10 | 10 | 9-1/4 | 672.0 | 1-9/32 | 5.157 | 120 |
| 8 | 5-1/2 | 7-1/4 | 227.1 | 1/2 | .785 | 130 |
| 8 | 6-1/2 | 7-1/4 | 268.3 | 19/32 | 1.108 | 130 |
| 8 | 8 | 7-1/4 | 330.3 | 3/4 | 1.767 | 130 |
| 6 | 5-1/2 | 5-1/4 | 119.1 | 5/16 | .307 | 140 |
| 6 | 8 | 5-1/4 | 173.2 | 7/16 | .601 | 140 |

FIGURE 7-3

TUNED-PORT RIGID BAFFLE PANEL FOR DRUM TYPE PERCUSSION INSTRUMENTS

BRIEF SUMMARY OF THE INVENTION

The invention is a tuned-port rigid baffle panel which mounts to the side opposite the beater drumhead membrane side of an acoustic drum and is used by musicians to enhance the live acoustic sound of these drum type percussion instruments by adding low-frequency punch to their performance. This low-frequency response enhancement is achieved by treating the drum as a bass-reflex enclosure and tuning the port of the rigid baffle panel to the appropriate percentage of the free-air resonant frequency of the beater drumhead membrane in order to control the peak amplitude of the beater drumhead membrane and extend the low-frequency response of the acoustic drum.

The tuned-port rigid baffle panel is circular in shape and contains a tuned-port of sufficient area to tune the drum to the proper maximum performance frequency. The rigid baffle panel is fastened to the side opposite the beater drumhead membrane side of a drum instrument by means of placing it concentrically against the edge of the exposed side of the drum shell and placing the existing drumhead rim over the rigid baffle panel clips and then securing these components with the connecting hardware. In this way the rigid baffle panel is securely fastened to the drum shell edge by means of the drumhead rim exerting force on the baffle panel clips which are secured to the rigid baffle panel. The connecting hardware assembly lugs provide the mechanical means for securing the rigid baffle panel to the drum shell via the drumhead rim. A rigid pot-plug is provided to minimize dust accumulation inside the acoustic drum when not is use. The rigid port-plug is also used to seal the acoustic drum at the tuned-port thus temporarily canceling the low-frequency response enhancement and creating an acoustic suspension condition for acoustical measurement and testing purposes.

Musical drum type percussion instruments require the use of the hands, drum sticks or foot pedal (in the case of a bass drum) to transfer the percussive force to the drum. This striking force creates an excitation of the element which restricts and controls the amount of sound being emitted from the drum due to the striking of the beater drumhead membrane. The tuned-port in the rigid baffle panel allows frequencies to be emitted in phase with the natural frequency of the beater drumhead membrane. This is achieved because the rear sound wave of the beater drumhead membrane has to fill the volume of the drum and travel a path length to the tuned-port before it can be radiated from the tuned-port. This delay of the rear wave allows it to be radiated from the tuned-port in phase with the next occurring front wave being radiated from the beater drumhead membrane. This is referred to as acoustic phase inversion and is the basis of bass-reflex design.

The advantage of using a tuned-port rigid baffle panel drum over an open-ended or double-headed drum is that the peak excursion at the resonant frequency of the beater drumhead membrane is reduced by means of the tuned-port. This extends the bass response and attenuates the uncontrolled resonance (boominess) resulting in a smoother and more controlled acoustic drum sound.

Although drumhead membranes have been used with a tuned-port in an attempt to control the drum resonance, they are inherently too flexible to resist the internal sound pressure inside the drum and consequently resonate themselves to compound the problem. The rigid baffle panel solves this problem by resisting excessive vibration at resonance and properly loading the beater drumhead membrane with the pressurized internal volume of air. This also insures that the correct frequency at which the tuned-port is to respond with its acoustic phase inversion to limit resonance is produced.

BRIEF DESCRIPTION OF THE DRAWINGS

FIGS. 7-1, 7-2, 7-3: tables of bass reflex design parameters of tuned-port rigid baffle panels for drum type percussion instruments.

DETAILED DESCRIPTION

Figure 1:
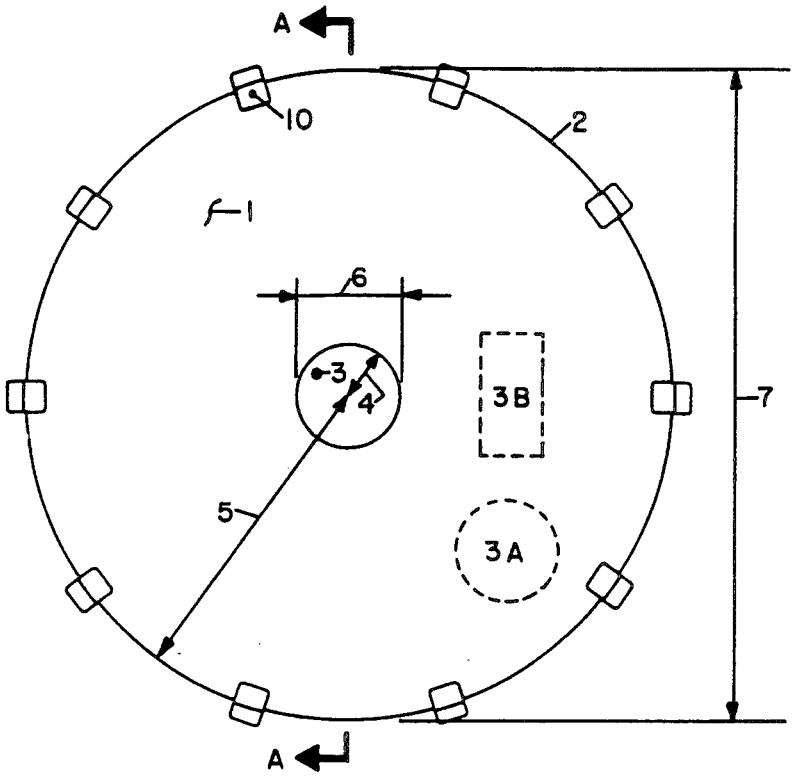
FIG. 1: elevation view shows the circular rigid baffle panel with its concentrically and non-concentrically located tuned-ports. Section line "A—A" is indicated. Secured baffle panel clips are shown around the outer circular edge.

FIG. 1) A tuned-port rigid baffle panel (1) is shown in elevation view which is characterized by an outer circular edge (2) and inner circular tuned-port (3) being concentric to outer circular edge (2) for convenience but may be placed at any location (3A) on the face of rigid baffle panel (1) and may be other than circular in shape (3B) but must be equivalent in area to the calculated performance area for the tuned-port (3) as required by the bass-reflex design parameters in FIGS. 7-1, 7-2, 7-3. Radius (4) refers to the radius of the tuned-port (3) and radius (5) refers to the radius of the rigid baffle panel (1). Diameter (6) refers to the diameter of the tuned-port (3) and diameter (7) refers tot eh diameter of the rigid baffle panel (1). Section Line "A—A" indicates the view which shows the thickness of the tuned-port rigid baffle panel (1) in FIG. 2. Secured baffle panel clips (10) are shown around the outer circular edge (2) of the tuned-port rigid baffle panel (1).

Figure 2:
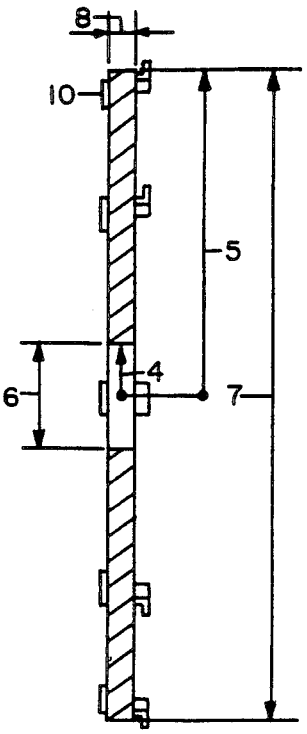
FIG. 2: section "A—A" shows the thickness of the rigid baffle panel and the concentrically located tuned-port. Baffle panel clips are indicated.

FIG. 2) Section "A—A" shows the cross-sectional thickness (8) of the tuned-port rigid baffle panel (1). The tuned-port radius (4), rigid baffle panel radius (5), tuned-port diameter (6) and rigid baffle panel diameter (7) are indicated. Baffle panel clips (10) occurring beyond are indicated as referred to in FIG. 1.

Figure 3:
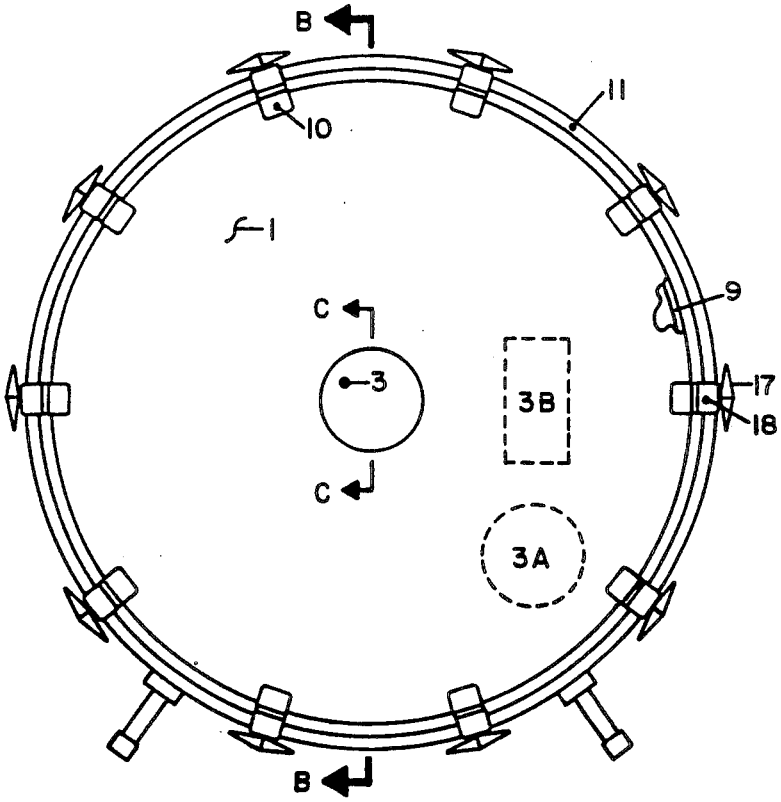
FIG. 3: elevation view shows the rigid baffle panel mounted to the front of a bass drum with baffle panel clips, drumhead rim and connecting hardware in place. Concentric and non-concentric tuned-port locations are shown. Section B—B and C—C are indicated. Rigid baffle panel is viewed as in FIG. 1.

FIG. 3) Elevation view shows the tuned-port rigid baffle panel (1) mounted to the drum shell edge (9) with baffle panel clips (10), drumhead rim (11) and tension rod (17) and tension rod bracket (18) in place. A portion of rigid baffle panel (1) is cut away to expose drum shell edge (9). Section "B—B" is indicated and refers to FIG. 4. Section "C—C" is indicated and refers to FIG. 6. The tuned-port rigid baffle panel (1) is viewed from as in FIG. 1.

Figure 4:
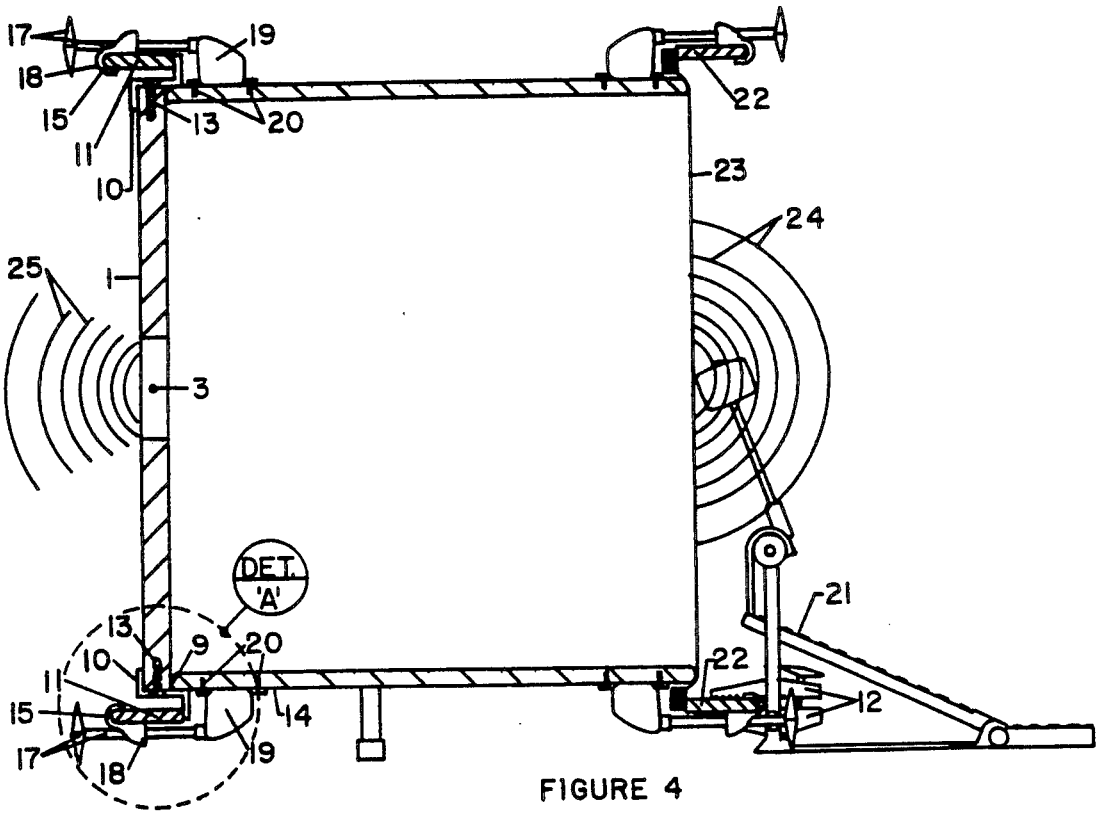
FIG. 4: section "B—B" shows the rigid baffle panel mounted to the bass drum as described in FIG. 3 with the drum pedal and beater drumhead membrane in place. In phase radiated sound waves are shown at the tuned-port and at the beater drumhead membrane. Detail "A" is indicated.

FIG. 4 Section "B—B" shows the tuned-port rigid baffle panel (1) mounted to the drum shell edge (9) as described in FIG. 3. In this view the tuned-port rigid baffle panel (1) is shown mounted against drum shell edge (9) by means of its secured baffle panel clip (10) which receives drumhead rim (11) which is tightened against baffle panel clip (10) that is secured to rigid baffle panel (1) by means of set screw (13) and rigid baffle panel (1) clamps on drum shell edge (9) by means of existing hardware which consists of tension rod (17), tension rod bracket (18) and lug connector (19) and lug connector mounting screws (20) which connect to the outer drum shell surface (14). Tension rod bracket (18) hooks over the outer edge (15) of drumhead rim (11) and tension rod (17) bolts into tension rod bracket (18) and tightens drumhead rim (11) to baffle panel clip (10) which secures rigid baffle panel (1) to drum shell edge (9) by clamping means. The drum pedal (21) is shown mounted to drumhead rim (22) by means of the existing drum pedal clamp (12) which is part of drum pedal (21) and beater drumhead membrane (23) is shown in a mode of oscillation sound waves (24) of the beater drumhead membrane (23) and the oscillating sound waves (25) of the tuned-port (3) emerge at the same time and in phase to control the resonance of the beater drumhead membrane (23) and extend the low-frequency response of the drum. This section "B—B" is indicated in FIG. 3. Detail "A") is indicated and refers to FIG. 5.

Figure 5:
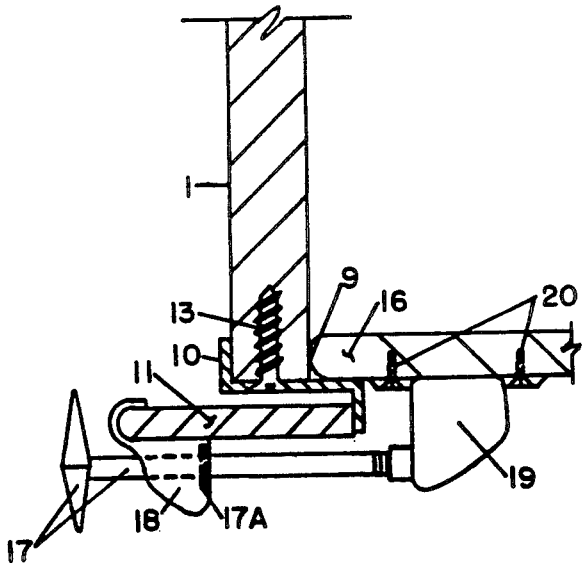
FIG. 5: detail "A" shows the drum shell, rigid baffle panel with fastened baffle panel clip, drumhead rim and connecting hardware assembly.

FIG. 5) Detail "A" shows the drum shell body (16) receiving the tuned-port rigid baffle panel (1) at drum shell edge (9). The baffle panel clip (10) is secured to tuned-port rigid baffle panel (1) by set screw (13). The drumhead rim (11) is placed on the baffle panel clip (10) which is secured by set screw (13) and tightened down by means of existing hardware which consists of tension rod (17), tension rod bracket (18), lug connector (19) and lug connector mounting screws (20). Turning tension rod (17) clamps tension rod bracket (18), drumhead rim (11), baffle panel clip (10) and rigid baffle panel (1) to drum shell edge (9). Retaining ring (17A) prevents tension rod (17) from slipping though tension rod bracket (18) when tightened.

Figure 6:
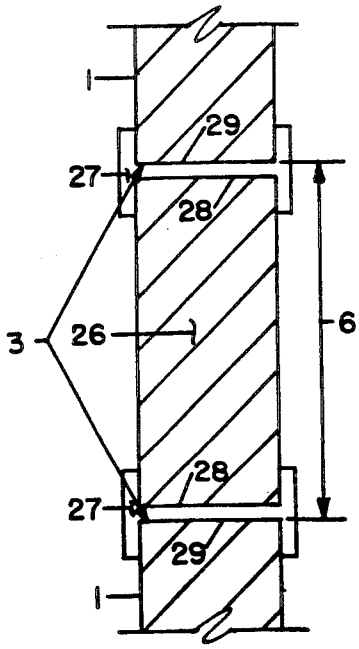
FIG. 6: section "C—C" shows the rigid port-plug installed in the tuned-port. Section break lines are shown above and below the tuned-port.

FIG. 6) Shows section "C—C" taken through a central portion of the tuned-port rigid baffle panel (1) as indicated in FIG. 3. A rigid port-plug (26) is inserted in tuned-port (3) and is held in place by rubber gasket (27) occurring at perimeter (28) of rigid port-plug (26) and at perimeter (29) of tuned-port hole diameter (6).

What is claimed is:

1. A baffle panel for a drum instrument having a drum shell and a beater membrane, said beater membrane having a resonant frequency having a peak amplitude, comprising:

a rigid panel, said panel being sufficiently thick, and made of sufficiently stiff materials so as to resist flexural movement of said panel;

means for mounting said panel on the drum instrument opposite the beater membrane of the drum instrument; and a port formed in said panel, said port having an area selected to provide a tuned sound output from the drum instrument wherein sound waves created by an impact against the beater membrane are radiated from said port in phase with and additively with sound waves radiated from the beater membrane, and the peak amplitude of the resonant frequency of the beater membrane is reduced and the drum instrument is provided with an extended low frequency response.

2. A baffle panel in accordance with claim 1 wherein said port has an area selected to give a tuned sound output from said drum instrument at the resonant frequency of the beater membrane.

3. A baffle panel in accordance with claim 1 wherein said port has an area selected to give a tuned sound output from said drum instrument at a frequency other than the resonant frequency of the beater membrane.

4. A baffle panel in accordance with claim 1, 2 or 3 wherein said tuned sound output has a frequency of about 50, 60, 70, 80, 90, 100, 110, 120, 130, or 140 hertz.

5. A baffle panel in accordance with claim 1, 2 or 3 wherein said tuned sound output has a frequency selected from a range of about 50 to about 140 hertz.

6. A baffle panel in accordance with claim 1, 2, or 3 wherein said tuned sound output has a frequency about 50 or 60 hertz.

7. A baffle panel in accordance with claim 1, 2, or 3 wherein said tuned sound output has a frequency selected from a range of about 50 to about 60 hertz.

8. A baffle panel in accordance with claim 1, 2 or 3 wherein said tuned sound output ha a frequency of about 70, 80, 90, 100, 110 , 120, 130, or 140 hertz.

9. A baffle panel in accordance with claim 1, 2 or 3 wherein said tuned sound output has a frequency selected from a range of about 70 to about 140 hertz.

10. A baffle panel in accordance with claim 1, 2 or 3 wherein said port is generally circular.

11. A baffle panel in accordance with claim 1, 2 or 3 wherein said port is non-circular.

12. A baffle panel in accordance with claim 1, 2 or 3 wherein said panel is circular.

13. A baffle panel in accordance with claim 1, 2 or 3 wherein said port is located within a central portion of said panel.

14. A baffle panel in accordance with claim 1, 2 or 3 wherein said port is located away from a central portion of said panel.

15. A baffle panel in accordance with claim 1, 2 or 3 wherein said means for mounting comprises a plurality of baffle panel clips mounted to said panel along an outer perimeter thereof, said clips matching and being adapted to be engaged by a drumhead rim, said drumhead rim being adapted to be secured to said drum instrument by a plurality of tensioning rod bracket assemblies mounted on the drum instrument.

16. A baffle panel in accordance with claim 1, 2 or 3 further comprising a rigid port plug, said port plug being mounted in said port in said panel by a resilient means for mounting.

17. A baffle panel in accordance with claim 16 wherein said port plug creates an acoustic suspension condition in said drum instrument.

18. A baffle panel in accordance with claim 16 or 17 wherein said port plug seals said baffle panel at said port.

19. A baffle panel for a drum instrument having a drum shell and a beater membrane, comprising:

a rigid circular panel, said panel being sufficiently thick, and made of sufficiently stiff materials so as to resist flexural movement of said panel;

means for mounting said panel on the drum instrument opposite the beater membrane of the drum instrument; and means for mounting said panel on the drum instrument opposite the beater membrane of the drum instrument; and a circular port formed in a central portion of said panel, said port having an area selected to provide a tuned sound output at a frequency selected from a range of about 50 to about 60 hertz from the drum instrument wherein sound waves created by an impact against the beater membrane are radiated from said port in phase with and additively with sound waves radiated from the beater membrane and the peak amplitude of the resonant frequency of the beater membrane is reduced and the drum instrument is provided with an extended low frequency response.

20. A baffle panel in accordance with claim 19, further comprising a rigid port plug, said port plug being mounted in said port in said panel by a resilient rubber gasket.

* * * * *